United States Patent [19]

Schaller et al.

[11] Patent Number: 4,803,605

[45] Date of Patent: Feb. 7, 1989

[54] FLASHLIGHT WITH A BACKUP SYSTEM

[75] Inventors: David R. Schaller, Janesville; El-Sayed Megahed, Madison; James Neyer, Middleton, all of Wis.; Tor Petterson, Palos Verdes Penninsula, Calif.

[73] Assignee: Rayovac Corporation, Madison, Wis.

[21] Appl. No.: 81,655

[22] Filed: Aug. 4, 1987

[51] Int. Cl.[4] ..... F21L 7/00

[52] U.S. Cl. ..... 362/184; 362/205; 362/208

[58] Field of Search ..... 362/184, 204, 205, 157, 362/190, 191, 192, 193, 202, 203, 208, 20

[56] References Cited

U.S. PATENT DOCUMENTS

| | | | |
|---|---|---|---|
| 1,946,059 | 2/1934 | Buchholz | 362/184 |
| 1,974,292 | 9/1934 | Walsh | 362/208 |
| 2,520,023 | 8/1950 | Allen | 362/184 |
| 2,716,700 | 8/1955 | La France | 362/184 |
| 2,966,580 | 12/1960 | Taylor | 362/184 |
| 3,299,262 | 1/1967 | Duncan | 362/157 |
| 4,152,755 | 5/1979 | Trosper et al. | 362/205 |
| 4,333,129 | 5/1982 | Ewing | 362/157 |
| 4,340,930 | 7/1982 | Carissimi | 362/204 |

FOREIGN PATENT DOCUMENTS

| | | | |
|---|---|---|---|
| 958509 | 3/1950 | France | 362/184 |

*Primary Examiner*—Samuel Scott
*Assistant Examiner*—Noah Kamen
*Attorney, Agent, or Firm*—Kenyon & Kenyon

[57] ABSTRACT

A hand-held flashlight has a housing for two independent electrical systems: a primary system and a backup system. Each of the systems includes a light source, a power source and a switching device for selectively connecting a power source to a corresponding light source. The backup system uses high performance components to insure that the flashlight is operational for long time periods. The backup system is actuated only after the the primary system has failed. An indicator announces when the backup system is in operation.

20 Claims, 3 Drawing Sheets

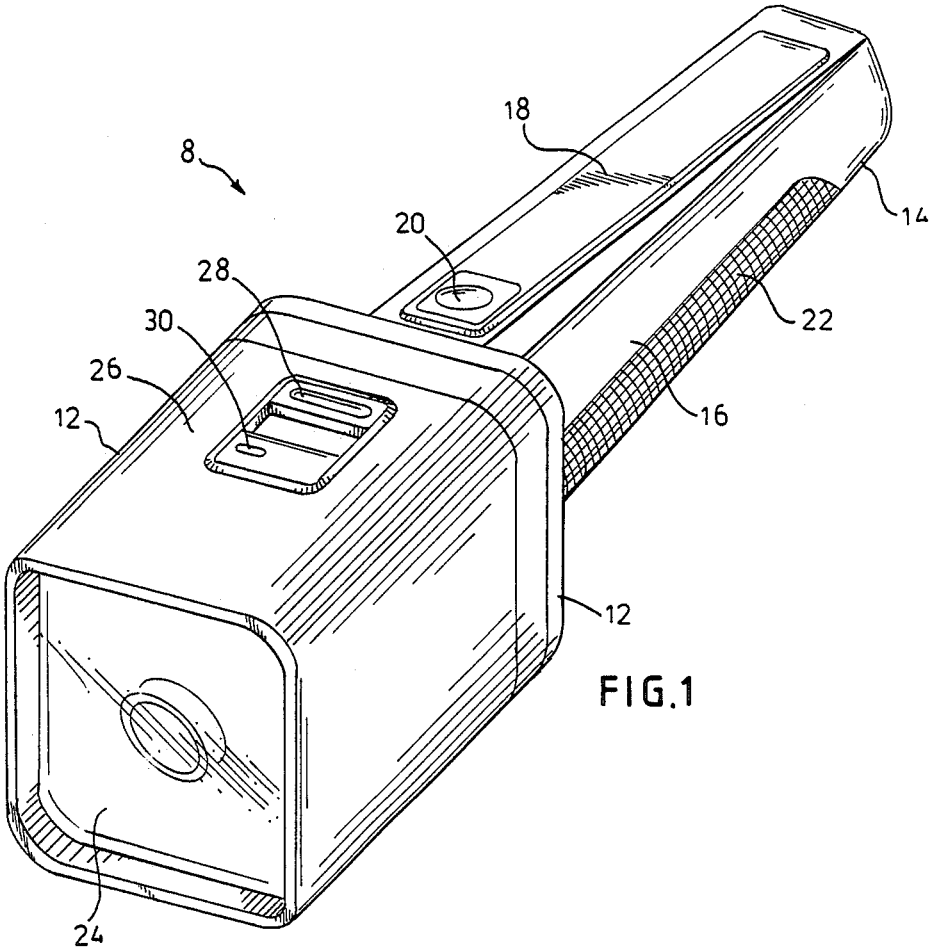
FIG.1
FIG.2
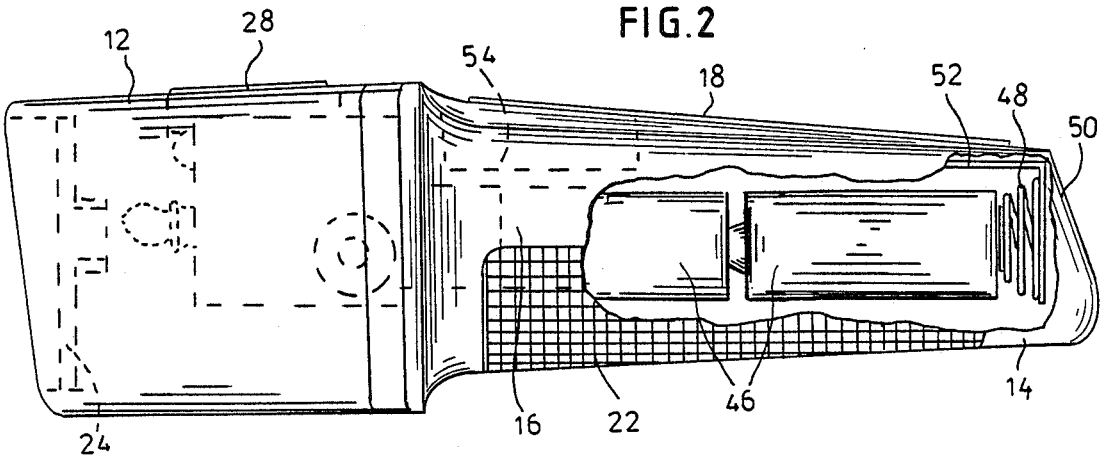

FLASHLIGHT WITH A BACKUP SYSTEM

BACKGROUND OF THE INVENTION

1. Field of the Invention

This invention pertains to a flashlight constructed with several redundant elements for long-term reliability and more particularly to a hand-held flashlight with a backup system which may be selectively activated when the primary electrical system has failed.

2. Description of the Prior Art

Flashlights, and especially hand-held flashlights are used in many instances as primary sources of light in locations which are situated too far for the use of light sources connected to an electric power distribution network, or in which locations the distribution network has failed. Frequently these flashlights, and especially the flashlights designated for emergency use only, are stored away for long time periods between activations. However the flashlights presently available are subject to failure even if they are not used frequently. Conventional flashlights usually have a single electrical system comprising one or more batteries which provide the power for the flashlight, a light bulb which generates the actual light beam, a switch for the selective actuation o the bulb, and interconnecting elements which provide the electrical path between these elements. All these elements are disposed in a common housing and the failure of any one of these elements results in the malfunction of the flashlight. For example, common batteries have a very limitted shelf life. After a relatively short time period has elapsed, these batteries are discharged even if they are not used. Furthermore the common batteries can produce various corrosive fumes which can degrade and ultimately cause the failure of the housing, the switch or the flashlight interconnecting elements. The switch is a mechanical device which is also prone to failure. Frequent activation of the flashlight causes a premature failure due to abnormal wear and tear of the contacts as well as metal fatigue of its components. If the switch is used infrequently, chemical action (due for example to fumes from the batteries as explained above)could cause the formation of non-conductive layers on the switch contacts. The useful life of light bulbs is affected by electrical shock caused an inrush current generated by the activation of the switch. The light bulbs are also affected by various mechanical shocks which are frequent when the flashlight is used in a rough environment. For example a flashlight bulbs frequently damaged when the flashlight is dropped. Finally the flashlight interconnecting elements are susceptible to long term chemical degradation as well as mechanical wear and tear.

In U.S. Pat. No. 4,333,129 a hand-held flashlight is disclosed in which two identical batteries disposed end-to-end are physically and electrically separated by a separator plate. Switching means are provided to couple the batteries in a common electrical circuit.

In U.S. Pat. No. 1,974,294 a device is disclosed comprising two separate flashlights connected by a hinge which allows the flashlights to be oriented either side-by-side to produce two parallel light beams or end-to-end to produce two beams directed in opposite directions.

In U.S. Pat. No. 3,299,262 a flashlight is disclosed which can be coupled to an external battery pack to provide a high intensity light beam if desired.

None of these references disclose a structure with the advantages described below.

OBJECTIVES AND SUMMARY OF THE INVENTION

An objective of the present invention is provide a flashlight with a backup system provided to insure the operation thereof in emergency conditions.

Another objective is to provide a flashlight which can be constructed economically, by the use of relatively inexpensive materials, and which in the long run is relatively inexpensive to operate.

A further objective is to provide a flashlight with a long shelf life to insure that it is operational even if used infrequently. Other objectives and advantages of the invention shall become apparent from the following description of the invention. Briefly a flashlight constructed in accordance with this invention comprises a housing in which two different electrical systems are provided for generating light beams. Both the first and the second system include a power source such as one or more batteries, a light bulb and a switch for selectively activating the respective system. Preferably the first or primary system has relatively inexpensive components which are expected to be replaced often, especially if the flashlight is used frequently. The second, or backup system comprises high performance components with relatively long shelf life, in the order of ten years or more. Preferably the two systems are independent and completely separated so that the failure of one system has no effect on the performance of the other system.

BRIEF DESCRIPTION OF THE FIGURES

FIG. 1 shows an isometric view of a flashlight constructed in accordance with the invention;

FIG. 2 shows a side view of the flashlight of FIG. 1;

DETAILED DESCRIPTION OF THE INVENTION

Figure 3:
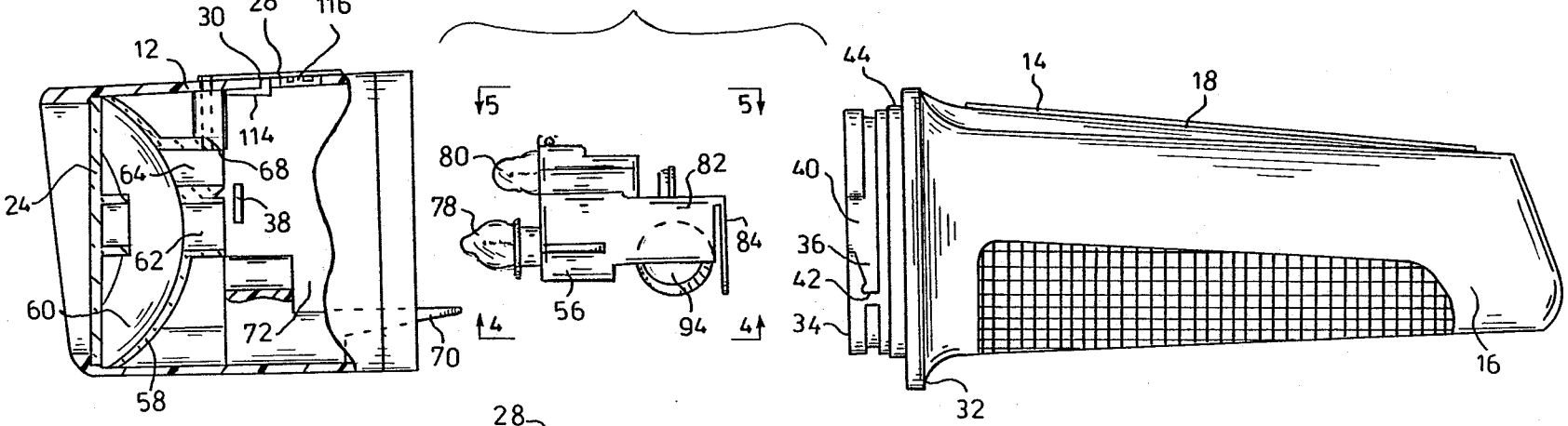
FIG. 3 shows an exploded view of the flashlight of FIG. 1.

A somewhat preferred embodiment shall now be described in conjunction with the drawings. The drawings illustrate a hand-held flashlight 8 with a housing 12 having two mating sections 12 and 14. Section 12 may be termed the head of the flashlight while the second section 14 may be termed its body. The flashlight body is generally elongated and is formed of a first longitudinal surface 16 which has an approximately semicircular cross-section and a relatively flat longitudinal section 18. A pushbutton 20 is provided toward a front end of surface 16. As shall be described in more detail below, the pushbutton 20 may be used to activate the primary electrical system of the flashlight 10. At least a portion of cylindrical surface is serrated as at 22 to provide a non-slip surface. Alternatively a serrated or knurled element made of a different colored material may be imbedded in surface 16. The whole body 12 is ergonomically shaped so that an operator can hold the flashlight comfortably with the thumb resting near pushbutton 20 for its activation. The head and body each include a cavity which forms a common enclosure when the two sections are joined.

The flashlight head 12 is generally square or rectangular and has larger overall cross-sectional dimensions than the body 14 for holding the secondary electrical system. The head 12 has a front lens 24 made of a transparent material to allow light to pass therethrough. The flashlight head also has a sidewall 26 corresponding to body surface 18, on which sidewall there is provided a slide switch 28. As described in more detail below, the slide switch 28 activates the secondary electrical system of the flashlight 10. Adjacent to the slide switch and slightly forward to it there is a relatively small indicating window or other means 30 provided to show the status of the secondary electrical system.

Flashlight housing 10 is preferably made of a highimpact plastic material which is relatively immune to normal chemical degradation. The body 14 is provided with an enlarged portion 32 which provides a gradual change between head 12 and the remaining portion of body 14. Portion 32 is terminated with a cylindrical neck 34 with a plurality of slanted exterior grooves 36. The head is similarly provided with lips 38. The lips 38 are disposed on an inner wall of the head 12 and are arranged for engagement with grooves 36. Thus grooves 36 and lips 38 provide a means of interlocking the head and body sections of the housing 10. For closing the housing the two sections are brought into an axial alignment with one lip 38 being adjacent to an openning 40 of groove 36. The two sections are then moved toward each other and the head is twisted clockwise until lip 38 comes to rest against wall 42. Neck 34 is provided with a ring shaped gasket 44 which is used to seal the interior of the flashlight housing. The gasket is made of a resilient material such as a synthetic rubber which urges the two housing sections axially away from each other. Thus when the two housing sections are interlocked as described above, the housing is sealed in a water- and air-tight manner.

As shown in FIG. 2, the body 14 houses two or more batteries 46. One of the batteries is in contact with a spring 48 secured to a rear wall 50 of the body 14. A conductive strip 52 extends from spring 48 to a switching mechanism 54 secured bellow flat surface 18. The switching mechanism is activated by pushbutton 20 as described below.

Refering now to FIGS. 3-6, within head 12 there is provided a light bulb assembly 56 and a reflector 58. The reflector 58 is permanently secured to the inner walls of the head 12 and has surface 60 coated with a reflective material. Reflector 58 is also provided with two cylindrical holes 62 and 64. Surface 60 is shaped to capture and direct light from a light bulb extending from hole 62 in a primary light beam through transparent lens 24. Lens 24 may be provided with a transparent cylindrical wall section 66 for concentrating the primary light beam. The inner wall of hole 64 is cylindrical and it terminates in a necked down section 68 for generating a backup light beam described below. A projection 70 extends rearwardly toward the housing body 14 and it cooperates with the inner walls 72 of the head 12 to engage light bulb assembly 56 in a friction fit. Thus the assembly 56 may be removed from the head if desired.

Figure 4:
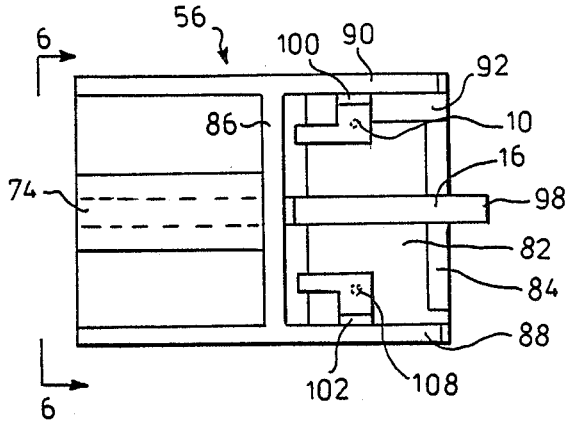
FIG. 4 shows a top view of a light bulb assembly for the flashlight of FIG. 1.

Assembly is provided with two cylindrical depressions 74 and 76 for holding a primary and a backup light bulb 78 and 80 respectively. As shown in FIG. 4, assembly 56 also includes an open chamber 82 defined by two upright walls 84, 86, assembly sidewalls 88, 90 and a bottom wall 92. This chamber 82 is provided for holding a secondary or backup battery 94.

Mounted on upright wall 84 there is a conductive strip 96 with a terminal surface 98. This strip extends along the inner surface of wall 84 along the bottom wall 92 and up on wall 86 until it reaches depression 74 to provide a first central connection for bulb 78. Another strip 99 can be seen partially in FIG. 5 and also extends within the assembly to depression 74 to form a second electrical connection for bulb 78. When flashlight is assembled, surface 98 comes into electrical contact with one of the batteries 46 and strip 99 is connected by electrical connection means to switching means 54.

Figure 5:
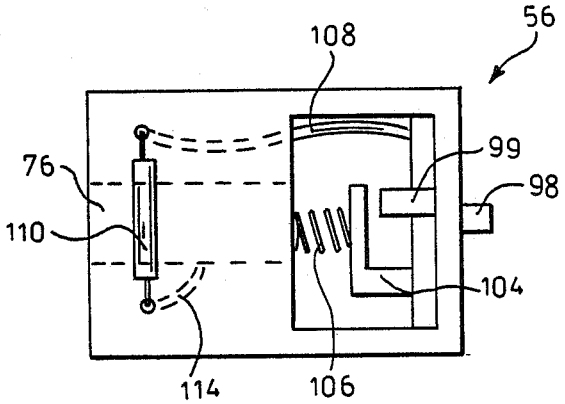
FIG. 5 shows a side view of the light bulb of FIG. 1.
Figure 6:
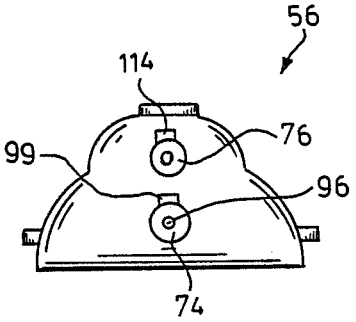
FIG. 6 shows a front view of the light bulb of FIG. 1.

Within chamber 82 there are provided two clips 100, 102 which hold battery 94 by its terminals. A strip 104 extends from clip 100 to a position adjacent to the inner end of depression 76, as shown in FIG. 5. A small spring 106 is secured to strip 104 to provide a first or central connection for the secondary bulb 80. A second strip 108 extends from clip 102 to a first terminal of a reed switch 110 mounted on the outside of assembly 56. A second terminal of the reed switch is connected to a conductive strip 112 which leads to and forms a second electrical connection for the secondary bulb 80.

When assembly 56 is inserted into head 12, bulb 78 is disposed within 62 so that its output is reflected outwardly through lens 24. Similarly bulb 80 extends into hole 64 so that light generated by this bulb is reflected by wall 64. A light guide 116 in the form of a narrow strip of transluscent material extends from the necked down portion 68 to the sidewall 28 of head 12. The guide captures a very small portion of the light generated by bulb 80 and transmits it outwardly to provide an indication that the secondary bulb 80 has been activated.

Switch 28 mounted on head 12 preferably includes a magnet 116 positioned so that as the switch 28 is between a first and a second position, the magnet selectively opens and closes the reed switch 110 on assembly 56.

Figure 7:
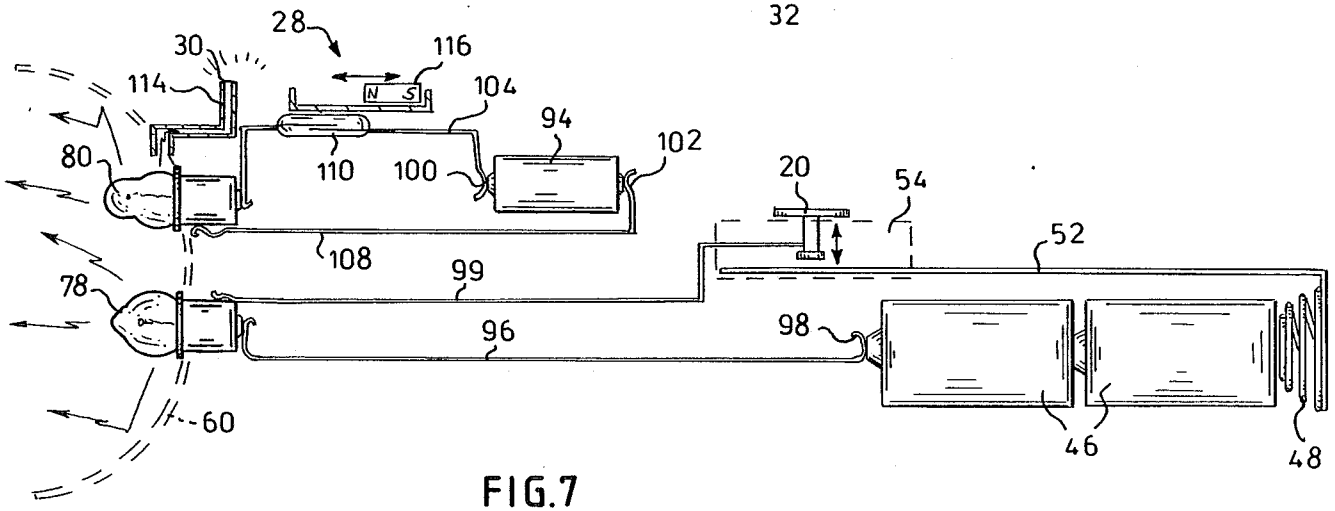
FIG. 7 is a somewhat schematic view of the two independent electrical systems disposed within the flashlight of FIG. 1.

The operation of the flashlight shall now be described in conjunction with FIG. 7 which is a somewhat stylized diagram of the various electrical components of the invention. As can be seen in FIG. 7 the flashlight is provided with two completely independent electrical systems. The first or primary system consists of batteries 46, switching means 54, light bulb 78 and interconnection elements including strips 52, 99, and 96, as well as spring 48. The batteries may be relatively inexpensive type C zinc-carbon or alkaline batteries.

Similarly bulb 78 may be relatively inexpensive bulb with a short useful life. Switching means 54 may be a mechanical push-on, push-off switch activated by pushbutton 20. This system is the primary system which is normally used to generate a light beam from bulb 78 by the selective activation of pushbutton 20.

The secondary or backup system consists of battery 94, reed switch 110 activated by magnet 116 operated by slide switch 28, bulb 80 and interconnecting strips 104 and 108. Battery 94 is preferably a battery of the type which has a very long shelf life, such as a lithium battery. The switching means provided for the system is also a high performance component which is not affected by chemical fumes or other environmental factors and therefore can be expected to operate for ten years or more even if it is used relatively infrequently. Finally bulb 80 is also preferably a high performance, long life component with a useful life of thousands of hours. This second system is activated for relatively short time periods, and only when the primary system has failed. Indicator 30 is provided to remind the user that the backup, rather then the primary system, is in operation, and that the primary system needs servicing.

Advantageously, as it can be seen from FIGS. 2 and 3 all the components of the backup system are housed in the head section of the flashlight so that the flashlight can be used even if the body section 14 is damaged or lost, or when it is desired to change the batteries of the primary system. Another important advantage of the invention is that, as it can be seen in FIGS. 3 and 5, as assembly 56 is removed from or inserted into the head 12, reed switch passes and is closed by magnet 116 temporarily, activating lightbulb 80. This action provides a fast and easy means of checking the secondary or backup system.

Obviously numerous modifications may be made to the invention without departing from its scope as defined in the appended claims.

We claim:

1. A hand-held flashlight comprising:

a flashlight head with a transparent lens and sidewalls defining a first cavity;

a flashlight body with at least one longitudinal wall and a second cavity;

housing interconnecting means for interconnecting said body and head to form a common enclosure;

a primary electrical system disposed in said enclosure for generating a primary beam through said lens;

a backup electrical system disposed in said enclosure and separate from said primary electrical system for generating a backup light beam through said lens, said backup electrical system comprising a backup battery disposed in said first cavity; and activation means for selectively activating said primary and backup systems.

2. The flashlight of claim 1 further comprising a reflector disposed in said head for reflecting said primary light beam.

3. The flashlight of claim 1 wherein said primary electric system comprises a primary power source, a light source and coupling means for selectively connecting said power source to said light source.

4. The flashlight of claim 3 wherein said primary power source comprises a battery disposed in said second cavity.

5. The flashlight of claim 3 wherein said light source comprises a light bulb disposed in said first cavity.

6. The flashlight of claim 3 wherein said coupling means comprises a switch disposed in said second cavity and operated by said activation means, and a plurality of conductive strips interconnecting said light source, said primary power source and said switch.

7. The flashlight of claim 6 wherein said activation means comprises a pushbutton mounted on said longitudinal wall.

8. The flashlight of claim 1 wherein said backup electric system comprises said backup power source, a light source and coupling means for selectively connecting said power source to said light source.

9. The flashlight of claim 8 wherein said light source comprises a light bulb disposed in said first cavity.

10. The flashlight of claim 8 wherein said coupling means comprises a switch disposed in said first cavity and operated by said activation means, and a plurality of conductive strips interconnecting said light source, said backup power source and said switch.

11. The flashlight of claim 10 wherein said activation means comprises a sliding member mounted on one of said sidewalls.

12. The flashlight of claim 11 wherein said switch is a reed switch and said sliding member includes a magnet for operating said reed switch.

13. The system of claim 8 further including an indicator for indicating that the backup system has been activated.

14. The system of claim 13 wherein said indicator comprises a strip of translucent material having one disposed near the backup light and terminating at said sidewall.

15. The flashlight of claim 1 wherein said primary and backup systems comprise primary and backup batteries respectively, said backup batteries having a shelf life which is substantially longer than the shelf life of said primary batteries.

16. A hand-held flashlight comprising:

a flashlight head with a transparent lens and sidewalls defining a first cavity;

a flashlight body with at least one longitudinal wall and a second cavity;

housing interconnecting means for interconnecting said body and head to form a common enclosure;

a primary electrical system disposed in said enclosure for generating a primary beam through said lens;

a backup electrical system disposed in said enclosure and separate from said primary electrical system for generating a backup light beam through said lens; said backup electrical system comprising a power source, a light source and switch means for energizing said backup electrical system;

a light bulb assembly for holding said light source and said switch means; and activation means for selectively activating said primary and backup systems.

17. The flashlight of claim 16 wherein said assembly includes a chamber for holding said power supply.

18. The flashlight of claim 17 wherein said power supply is a lithium battery.

19. A flashlight comprising:

a housing consisting of a head, and a body and means for connecting said head and said body in a matting relationship;

a first electrical system completely disposed in said head, said first electrical system remaining intact when the body and head are separated for generating a first light beam; and a second electrical system substantially disposed in said body for generating a second light beam emitted through said head.

20. A hand-held flashlight comprising:

a flashlight head with a transparent lens and sidewalls defining a first cavity;

a flashlight body with at least one longitudinal wall and a second cavity;

housing interconnecting means for interconnecting said body and head to form a common enclosure;

a primary electrical system disposed in said enclosure for generating a primary beam through said lens;

a backup electrical system disposed in said enclosure and separate from said primary electrical system for generating a backup light beam; said backup electrical system comprising a power source, a light source and coupling means for selectively connecting said power source to said light source;

an assembly removably disposed in said first cavity, said assembly including said power source and said light source, said coupling means being arranged and constructed to activate said backup system as said assembly is inserted into and removed from said first cavity.

activation means for selectively activating said primary and backup systems.

* * * * *

UNITED STATES PATENT AND TRADEMARK OFFICE

CERTIFICATE OF CORRECTION

PATENT NO. : 4,803,605

DATED : February 7, 1989

INVENTOR(S) : David R. Schaller, et al.

It is certified that error appears in the above-identified patent and that said Letters Patent is hereby corrected as shown below:

| Column | Line | |
|---|---|---|
| 1 | 27 | Please delete "o" and insert --of--. |
| 1 | 46 | Please insert --by-- after "caused". |
| 1 | 51 | Please insert --are-- before "frequently". |
| 3 | 18 | Please delete "highim-" and insert --high-im- --. |
| 3 | 67 | Please insert --56-- after "Assembly". |
| 4 | 29 | Please insert --hole-- after "within". |

UNITED STATES PATENT AND TRADEMARK OFFICE

CERTIFICATE OF CORRECTION

PATENT NO. : 4,803,605

DATED : February 7, 1989

INVENTOR(S) : David R. Schaller, et al.

It is certified that error appears in the above-identified patent and that said Letters Patent is hereby corrected as shown below:

| Column | Line | |
|---|---|---|
| 5 | 10 | Please insert --,-- after "3". |
| 6 | 47 | Please delete "matting" and insert --mating--. |
| 6 | 50 | Please delete return so that it reads "head, said first electrical system...". |
| 6 | 55 | Please delete return so that it reads "said body for generating ...". |

Signed and Sealed this

Eleventh Day of December, 1990

*Attest:*

*Attesting Officer*

HARRY F. MANBECK, JR.

*Commissioner of Patents and Trademarks*